United States Patent [19]

Salzmann

[11] 4,122,884

[45] Oct. 31, 1978

[54] VERTICAL VENETIAN BLIND CONSTRUCTION

[75] Inventor: Ferdinand F. Salzmann, Middleton, Wis.

[73] Assignee: Consolidated Foods Corporation, Chicago, Ill.

[21] Appl. No.: 762,197

[22] Filed: Jan. 24, 1977

[51] Int. Cl.[2] ..... E06B 9/30

[52] U.S. Cl. ..... 160/168 R; 160/176 R; 160/178 R

[58] Field of Search ..... 160/168, 172, 173, 176, 160/126

[56] References Cited

U.S. PATENT DOCUMENTS

| | | | |
|---|---|---|---|
| 2,993,535 | 7/1961 | Taylor | 160/173 |
| 3,231,007 | 1/1966 | Kerr | 160/126 |
| 3,280,891 | 10/1966 | Eldredge, Jr. et al. | 160/172 |

*Primary Examiner*—Peter M. Caun

*Attorney, Agent, or Firm*—Morsbach & Pillote

[57] ABSTRACT

A vertical venetian blind construction in which carriages having rotatable slat carriers are mounted for movement along a horizontal channel by traverse cords that extend lengthwise of the channel. A spline shaft extends lengthwise of the channel and the carriages have gears that mesh with the spline shaft for rotating the slat carriers in response to the turning of the shaft.

17 Claims, 13 Drawing Figures

VERTICAL VENETIAN BLIND CONSTRUCTION

BACKGROUND OF THE INVENTION

This invention relates to a vertical venetian blind of the type in which the slats are supported on a carriage for movement along the trackway to enable opening and closing of the blind and in which the slats are also supported on the carriage for rotation about the lengthwise axis of the slat, to control light that passes through the blind, an example of which is shown in U.S. Patent to Eldridge, Jr. et al, No. 3,280,891. In the vertical venetian blind construction disclosed in that patent, the carriages are moved along a channel shaped trackway by means of traverse cords having relatively parallel runs extending lengthwise of the trackway and connected to a lead or master carriage, and with links interconnecting adjacent carriages to control spacing between the carriages. The slats on the several carriages are simultaneously rotated by a spline shaft that extends longitudinally of the track and the carriages each have rack and pinion gearing that meshes with the spline shaft and which rotates slot carriers connected to each of the slats. The spline shaft is driven by a cord and pulley type drive through a speed reducer located on the end of the spline shaft.

Such vertical venetian blind apparatus require a relative large number of carriages for each installation, with each carrier having a slat carrier, gears for rotating the slat carrier from the spline shaft, and carriage spacer links to control spacing between the carriages. The prior venetian blind construction was such that it was relatively expensive to manufacture and assemble the various parts that made up each carriage including the gearing and spacer links. Moreover, the traverse cords for moving the carriages along the channel are located within the channel and, in the prior constructions, it was a tedious and time-consuming operation to connect the traverse cord runs to the lead or master carriages. Further, in the prior vertical venetian blind constructions, the drive mechanism for rotating the spline shaft was located at the end of the channel and necessitated substantial space between the end slat and the window opening in order to operate the blind so that there was a light passage between the end slat and the window opening.

SUMMARY OF THE INVENTION

The present invention relates to a vertical venetian blind construction in which carriages having rotatable slat carriers are mounted for movement along a horizontal support channel by means of traverse cords extending lengthwise of the channel and in which the slat carriers on the several carriages are simultaneously rotated by means of a spline shaft extending longitudinally of the channel and gear mechanism on each of the carriages that mesh with the spline shaft.

It is the general object of the present invention to provide a vertical venetian blind construction in which the carriages, slat carriers and gearing can be economically fabricated and assembled; in which the traverse cords can be easily and reliably connected to the lead or master carriage; and in which the slats when closed can extend alongside the window opening so as to substantially avoid passage of light therebetween.

One aspect of the present invention resides in the improved construction of the slat carriages. The carriages, slat carriers, and rack and pinion gearing are constructed and arranged so that the carriers and racks can be inserted as a subassembly into the carriages in such a manner that proper timing of the slat carriers on the several carriages is assured; the spacer links are formed integrally with the carriages so that it is unnecessary to separately form and assemble the spacer links on the carriages; and the carriages are formed with cord locks at their underside and internal cord passages opening adjacent the cord locks at the underside of the carriages to facilitate connection of the traverse cords to the lead or master carriage.

Another aspect of the present invention resides in the construction and arrangement of the drive and speed reducer mechanism for the splined slat carrier adjusting shaft and which enables operation of the slat adjusting shaft from either side of the track in such a manner that the slats can extend to the end of the track when closed to avoid light passage between the blind and window opening.

These, together with other objects and features and advantages of the present invention will be more readily understood by reference to the following detailed description when taken in connection with the accompanying drawings wherein.

Figure 1:
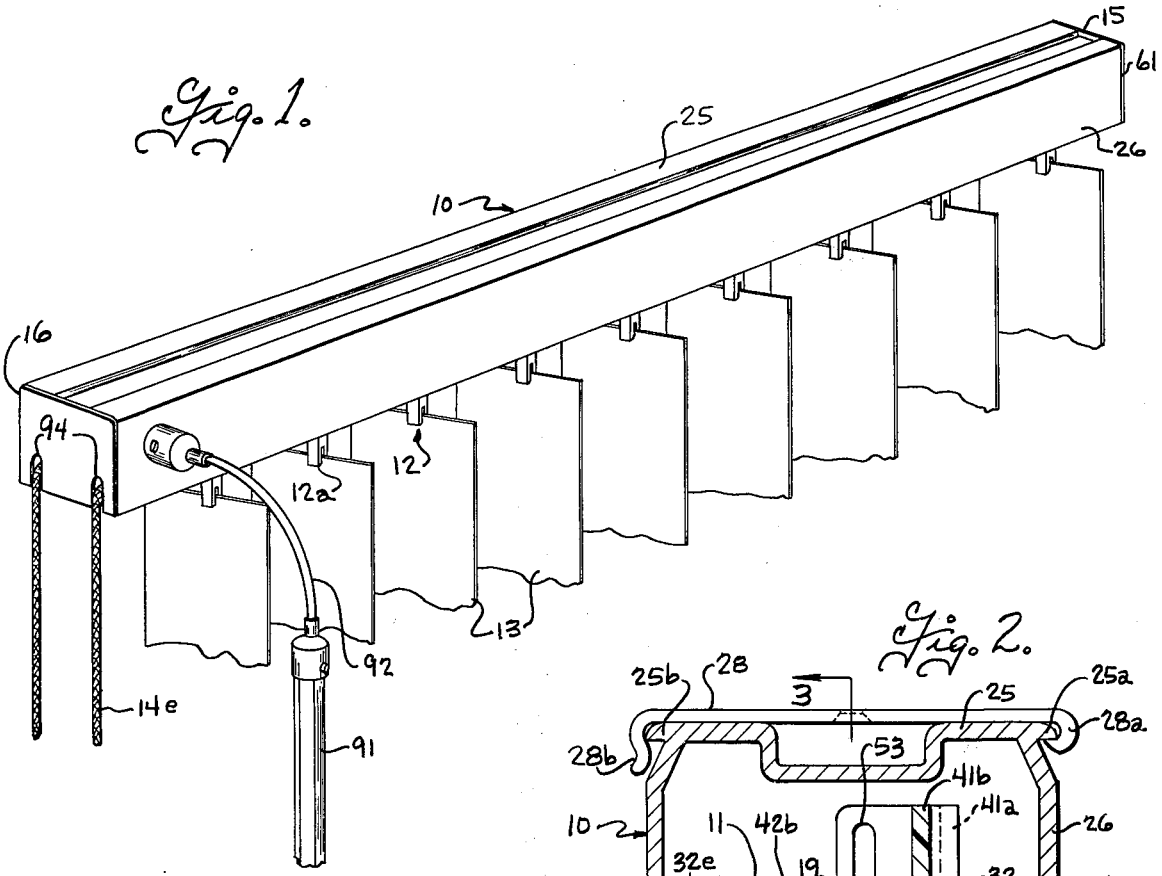
FIG. 1 is a perspective view of a vertical venetian blind construction embodying the present invention.

The vertical venetian blind apparatus of the present invention in general includes an elongated track herein shown in the form of a channel 10 adapted to be mounted horizontallly at one side of a window opening, a plurality of carriages 11 mounted for movement along the channel 10, with each carriage having a slat carrier 12 supported thereon for rotation about a vertical axis to rotate the slats 13 about their lengthwise axis. The carriages 11 are moved along the track by traverse cords 14 entrained over cord guides mounted in end fittings 15 and 16 at opposite ends of the housing. The traverse cords have one run thereof connected to a lead or master carriage to move the same along the track and the lead carriage is connected to an adjacent carriage and the adjacent carriages in turn connected to each other by spacer links 17 that limit separating movement of the carriages. A splined shaft 19 extends lengthwise of the housing and through the carriages and gear mechanism 21 is provided on each of the carriages for rotating the respective slat carrier in response to turning of the shaft. The shaft 19 is rotatably supported in the end fittings 15 and 16 and a shaft drive mchanism 22 is provided on one of the fittings 16 for rotating the shaft.

Figure 2:
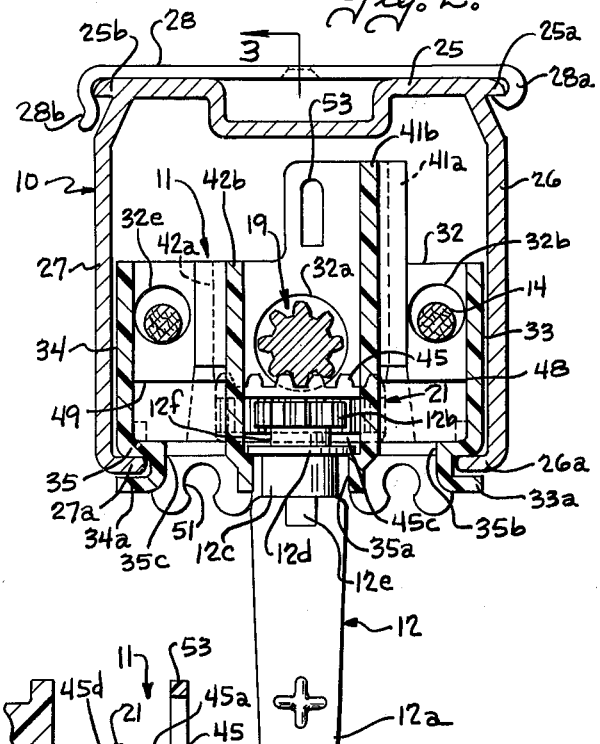
FIG. 2 is a vertical sectional view through the guide channel and carriage taken on the plane 2—2 of FIG. 3.

The guide channel 10 has a top wall 25 and spaced side walls 26 and 27. Any suitable means may be provided for mounting the channel at one side of a window opening and, as best shown in FIG. 2, the channel is provided with lengthwise extending top flanges **25*a* and 25*b* adjacent opposite edges of the top wall adapted to engage a bracket 28 having flange engaging portions 28*a* and 28*b*. The brackets 28 can be secured to an overhead surface as by fasteners or, alternatively, the bracket 28** can be secured to a suitable wall mounting bracket (not shown).

The carriages 11 each comprise a body advantageously molded of a synthetic resin material and having spaced side walls 31, 32, end walls 33 and 34 extending between the side walls, and a bottom wall 25. The carriages are slidably supported in the channel shaped rack and, as shown, the track has inwardly directing flanges **26*a* and 27*a* along the lower edges of the side walls 36 and 27 and the carriages have L-shaped retainer flanges 33*a* and 34*a* offset below the side walls and arranged to engage the inwardly directed flanges on the channel to guide the carriages in the channel during movement therealong. When the carriages are mounted in the channel, their side walls 31 and 32 extend transverse of the channel and their end walls 33 and 34 extend generally parallel to the side walls of the channel with the bottom wall 35 extending across the open side of the channel. The side walls 31 and 32 respectively have axially aligned shaft openings 31*a* and 32*a* therein preferably located medially between the end walls 33 and 34 and the side walls 31 and 32 also have cord openings 31*b*, 32*b* and 31*c*, 32*c* (FIG. 5) arranged in aligned pairs at relatively opposite sides of the shaft opening 31*a*, 32*a*. The bottom wall 35 has a carrier opening 35*a* therein adapted to have a portion of the slat carrier 12 extend downwaredly therethrough and a pair of cord openings 35*b* and 35*c* at opposite sides of the carrier opening 35*a*. The carriers also have intermediate walls 41 and 42 that extend between the spaced side walls and separate the housing into a central carrier passage that extends upwardly from the carrier opening 35*a* and laterally spaced cord passages at opposite sides of the central carrier passage, and which cord passages extend from the top of the carriages past the cord openings 31*b*, 32*b* and 31*c*, 32*c* in the side walls 31 and 32 to the cord openings 35*b* and 35*c*** in the bottom wall.

Figure 3:
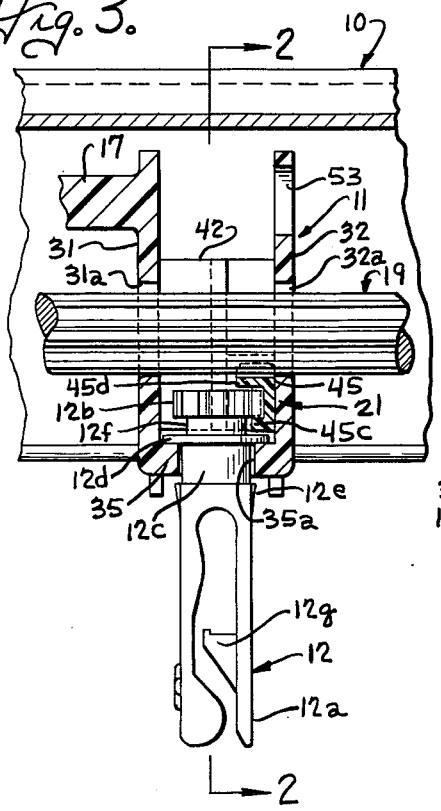
FIG. 3 is a fragmentary longitudinal sectional view taken on the plane 3—3 of FIG. 2.

The slat carriers 12 each have a slat engaging portion **12*a* at their lower end and a pinion gear 12*b* at their upper end. For reasons discussed hereinafter, the slat engaging portion 12*a* of each carrier is preferably formed of a non-circular cross section, herein shown of generally rectangular cross-sectional configuration and the carrier opening 35*a* in the bottom wall is formed with a complimentary configuration dimensioned to receive the lower slat engaging portion 12*a* with sufficient clearance to allow easy insertion of the slat carrier into the opening 35*a*, when the slat carrier is located in a preselected angular position. The slat carriers also have a cylindrical portion 12*c* above the non-circular slat engaging portion 12*a*, which cylindrical portion is dimensioned no larger than the minor cross-sectional dimension of the carrier opening 35*a* to allow free rotation of the slat carrier when the cylindrical portion 12*c* is located in the carrier opening in the bottom wall. An annular flange 12*d* is preferably provided on the slat carrier above the cylindrical portion and adapted to be received in a complimentary recess 35*d* in the upper surface of the bottom wall to rotatably support the carrier on the bottom wall. As best shown in FIG. 3, wedge-shaped lugs 12*e* are provided at the upper end of the non-circular slat engaging portion 12*a* of the slat carrier, which lugs are adapted to snap through the opening 35*a*** in the bottom wall and inhibit upward movement of the slat carriers after they have been assembled on the carriages.

The spline shaft 19 extends through the shaft openings **31*a* and 32*a* in the side wall housings, when the carriages are assembled on the channel, and a rack member 45 is provided in each carriage for turning the respective slat carrier in response to rotation of the spline shaft. The rack members 45 each have a first rack 45*a* along the top adapted to mesh with the spline shaft 19 and a second rack 45*b* along the side adapted to mesh with the pinion gear 12*b* on the upper end of the slat carrier. The carriages, rack members and slat carriers are arranged so that the slat carriers and rack members can be inserted as a subassembly into the carriages, and in such a manner as to assure proper timing of the gears on the rack member and slat carrier. For this purpose, the rack member is formed with a first flange 45*c* below the side rack 45*b* and the slat carrier is formed with a peripheral recess 12*f* below the pinion gear 12*b* for receiving the flange 45*c* on the rack member. The rack members are also provided with a second flange 45*d* above the side rack 45*b*** and which overlies the upper surface of the pinion gear on the slat carrier to inhibit displacement of the rack member in a direction paralleling the axis of the slot carrier.

Figure 4:
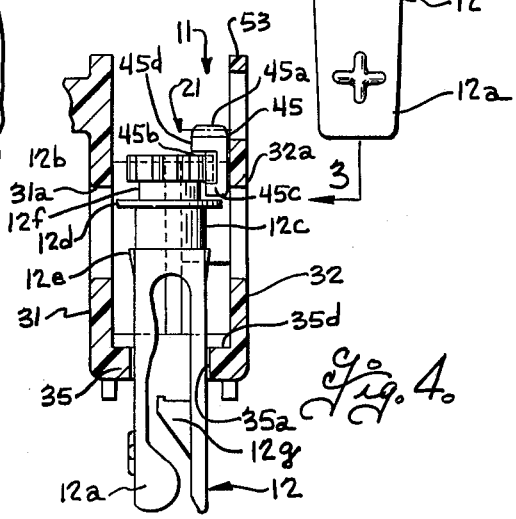
FIG. 4 is a vertical sectional view through a carriage and illustrating assembly of the slat carrier and rack member into the carriage.
Figure 6:
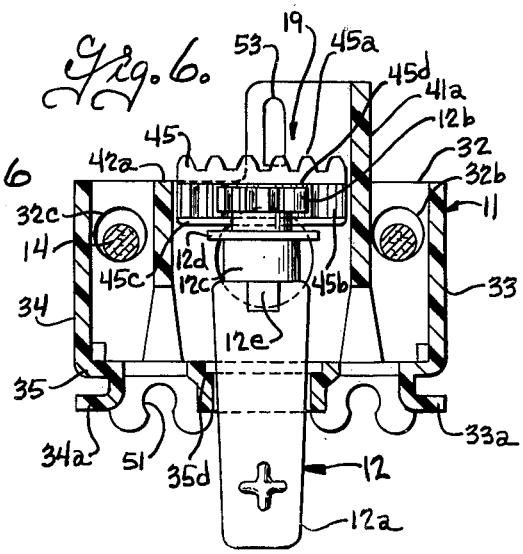
FIG. 6 is a vertical sectional view taken on the plane 6—6 of FIG. 5 and illustrating assembly of the slat carrier and rack member on a carriage.

The intermediate walls 41 and 42 of the carriage have portions **41*a*, 42*a* extending laterally from the wall 32, which portions are spaced apart a distance corresponding to the length of the rack member to guidably receive the rack member therebetween and longitudinally position the rack member during insertion of the rack member and slat carrier into the carriage. As best shown in FIG. 6, the lower ends of the wall portions 41*a* and 42*a* are spaced above the bottom wall 35 of the carriage, to allow lengthwise reciprocation of the rack member when it is fully assembled on the carriage. Guide ribs 48 and 49 extend upwardly from the bottom wall and are laterally spaced from the side wall 32, to laterally guide the rack member during reciprocation. The other portions 41*b*, 42*b* of the intermediate walls 41 and 42 are spaced relatively closer together than the wall portions 41*a* and 42*a* so as to form, with wall portions 41*a*, 42*a*, a central carrier passage having a cross-sectional configuration generally corresponding to the cross-sectional configuration of the slat carrier when the rack member is assembled thereon, so as to thereby guide the subassembly and hold the rack member in assembled relation on the slat carrier, during insertion of the subassembly into the carriage as shown in FIGS. 4 and 6. When the slat carrier and rack member are fully inserted into the carriage, the rack member is guidably supported for reciprocation by the upper surface of the bottom wall, the inner surface of the side wall 32, and the flanges 48 and 49. The flange 12***d* on the slat carrier rests on the bottom wall of the carriage to rotatably support the slat carrier and the flanges 45*c*, 45*d* on the rack member 45 engage relatively opposite the sides of the pinion 12*b* on the slat carrier to hold the rack member and slat carrier in assembled relation. Any suitable means may be provided for attaching the slats 13 to the slat carriers 12 and, as shown in FIGS. 3 and 4, the slat engaging portions 12*a* are bifurcated to receive the upper end of a slat and have a hook or lug 12*a* arranged to extend through an opening in the upper portion of the slat to support the slat.

Figure 11:
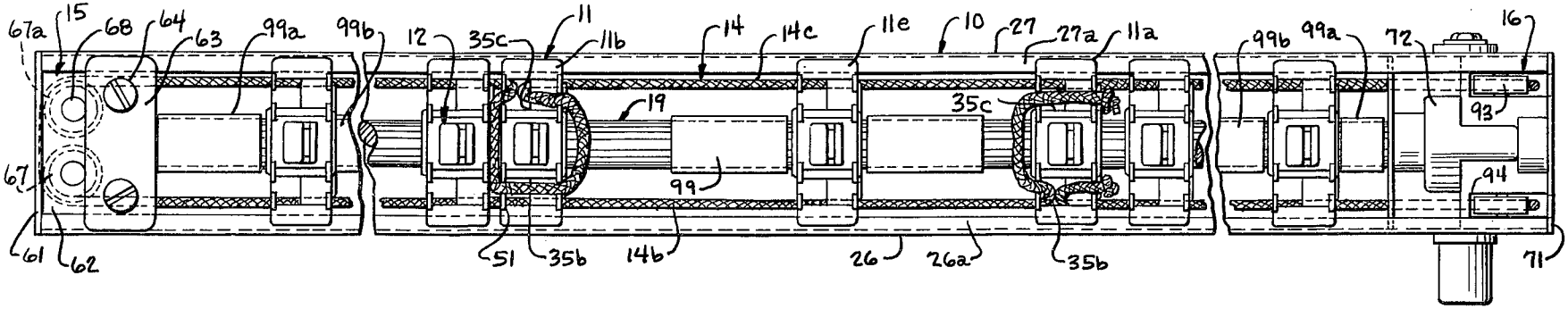
FIG. 11 is a bottom view of a vertical venetian blind assembly arranged for two-way draw.
Figure 12:
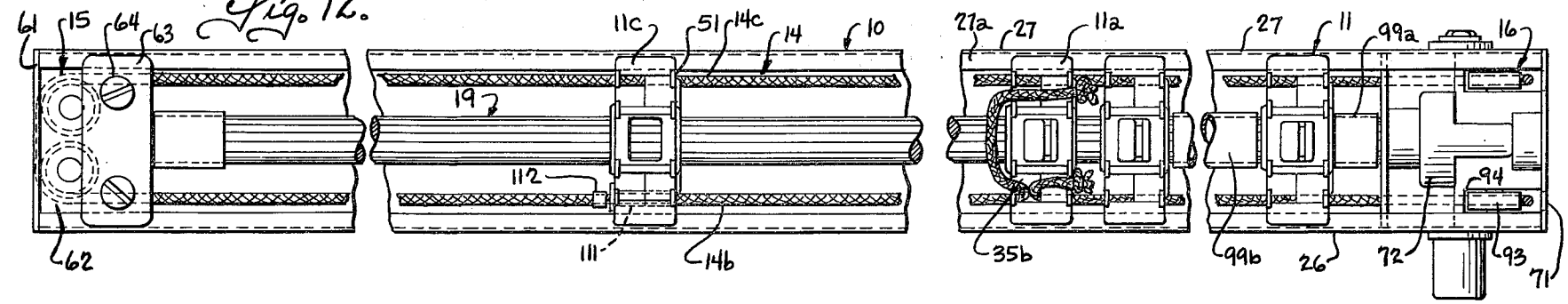
FIG. 12 is a bottom view of a vertical venetian blind apparatus arranged for one-way draw.

The traverse cords 14 have relatively parallel runs 14*b* and 14*c* inside the channel and, when the carriages are assembled in the channel, the runs 14*b* and 14*c* of the traverse cord extend through the aligned parts of openings 31*b*, 32*b* and 31*c*, 32*c*. In a two-way draw blind apparatus as shown in FIG. 11, there are two master or lead carriages designated 11*a* and 11*b* and one traverse cord 14*b* is connected to one master carriage 11*a* and the other traverse 14*c* is connected to the other master carriage 11*b*. In a one-way draw type vertical venetian blind apparatus as shown in FIG. 12, there is only one master carriage 11*a* and one of the runs of the traverse cord 14*b* is connected to the single master carriage.

The cord openings in the side walls of the carriages are spaced a substantial distance above the bottom wall of the carriages. However, the carriage construction provides cord guide passages that extend from the cord openings to the underside of the carriage so that it is possible to draw a portion of the traverse cord that extends between the cord openings in the side walls downwardly between the side walls to the underside of the carriage. Cord locks are provided at the bottom of each carriage and, in the preferred embodiment shown, the cord locks are in the form of four downwardly opening notches 51, two in each side wall adjacent the respective cord opening 35*b*, 35*c*. Thus, in order to connect an intermediate portion of one of the traverse cords such as 14*c* to one master carrier 11*b* in a biparting type venetian blind apparatus, a cord loop is drawn downwardly and out through one cord opening 35*c* in the bottom wall and the cord loop is then passed through the four cord notches 51 on the master slide 11*a* as shown in FIG. 11 to thereby lock the cord to the slide body 11*b*. The end portions of the cord of the other cord run 14*b* can be drawn downwardly through the cord opening 35*b* in the bottom wall and the end portions then passed through the cord lock notches in the master slide 11*b* as shown in FIG. 11, and the ends thereafter knotted as shown to secure the cord run 14*b* to the slide body 11*a*. A similar arrangement is utilized to connect the traverse cord 14*b* to the slide body 11*a* in a one-way type venetian blind apparatus as shown in FIG. 12. As best shown in FIGS. 2 and 6, the cord notches are formed with a restricted outer end portion to retain the cords in the notches, but the notches themselves are preferably dimensioned so as to loosely receive the cord.

Figure 5:
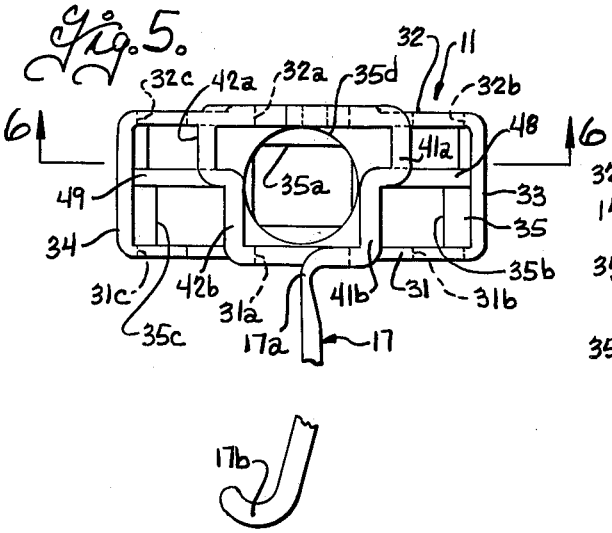
FIG. 5 is a top plan view of a carriage.
Figure 13:
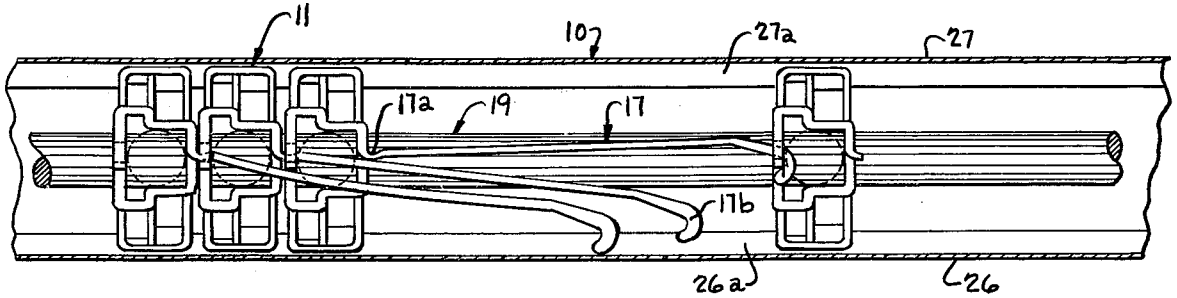
FIG. 13 is a fragmentary horizontal sectional view through a vertical venetian blind apparatus illustrating the links for controlling spacing between the carriages.

The traverse cords are arranged to move the master carrier or carriers along the channel. In order to effect movement of the other carriers, spacer arms 17 are provided on each carrier which are arranged to engage an adjacent carrier. The spacer arms 17 are advantageously formed integrally with each carriage and molded of synthetic material at the time that the carriage is molded. As best shown in FIGS. 5 and 13, the spacer arms are integrally joined to one wall 31 of each carriage along a thin flex line 17*a*, and the spacer arms extend laterally from the side wall of the carriage a distance slightly less than the width of the slats to be used and terminate in hook portions 17*b* at their free ends. An opening 53 is provided in the other wall 32 of each carriage and is dimensioned to loosely receive the shank portion of the spacer arm 17 on the adjacent carriage. The spacer arms are preferably mounted for swinging in a horizontal plane and, as shown, are integrally formed with an upwardly extending projection of the side wall 31 of the carriage at a level slightly above the main portion of the side wall 31 and the openings 32 are similarly formed in an upwardly extending projection of the side wall 32. Thus, the spacer arms can swing laterally relative to the respective carriage and over the upper edge of the side walls on the adjacent carriage when the carriages are moved toward each other as shown at the left in FIG. 13. When the lead carriages advance, it moves away from the next adjacent carriage until the hook portion on the spacer arm engages the side wall 32 of the adjacent carriage to thereafter draw the carriage with the lead carriage. This is continued in sequence as the lead carriage moves across the rod. The ends of the spacer arms are preferably angulated slightly as indicated at 17*c*, so the lead portion of the spacer arm on one carriage is cammed laterally by engagement with the hinged portion of the spacer arm on the adjacent carriage, when the carriages are moved towards each other to a collapsed position.

Figure 10:
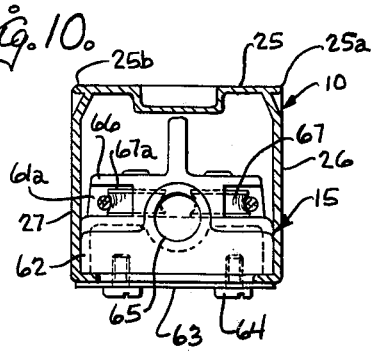
FIG. 10 is a fragmentary vertical sectional view taken on the plane 10—10 of FIG. 9.
Figure 9:
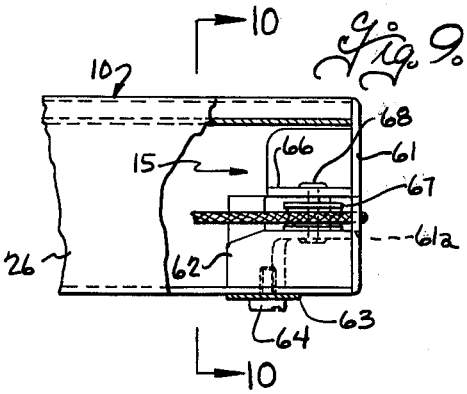
FIG. 9 is a fragmentary side elevational view of the other end of the channel with parts of the side wall broken away to illustrate the traverse cord return mechanism.

The end fitting 15 is disposed substantially entirely inside one end of the channel and comprises a one-piece body conveniently molded of a synthetic resin material and having a relatively thin end wall 61 that overlies and closes one end of the channel, and a body portion 62 that extends from the end wall into the channel adjacent the open side thereof and which is removably secured to the channel as by clamp plates 63 and fasteners 64. The body portion 62 has a socket 65 (FIG. 10) opening into the channel for rotatably receiving and supporting one end of the spline shaft 19, and a flange 66 that is spaced above the body portion 62. Cord guide pulleys 67, 67*a* are positioned between the flange 66 and the body portion 62 and supported for rotation about upright pins 68. The traverse cord between the runs 14*b* and 14*c* is adapted to pass around the guide pulleys 67, 67*a* and, in order to facilitate threading of the cord around the pulleys, a slot or opening 61*a* is formed in the end wall between the flange 66 and the body portion 62.

Figure 7:
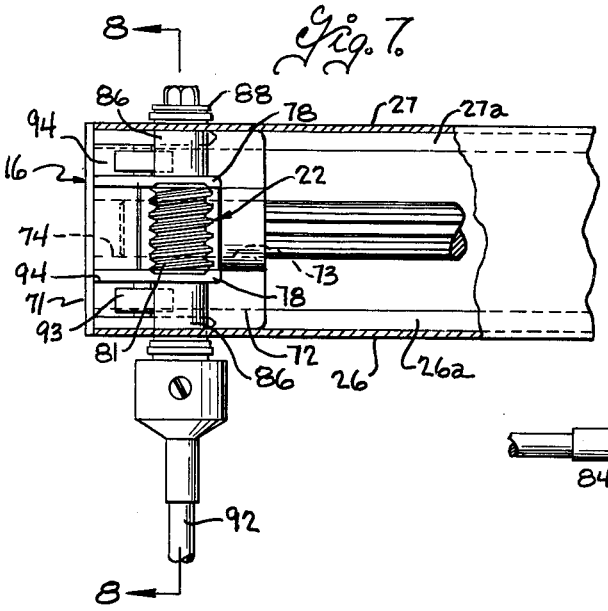
FIG. 7 is a fragmentary top plan view of one end of the vertical venetian blind apparatus with a portion of the top wall on the channel broken away to illustrate the shaft drive mechanism.
Figure 8:
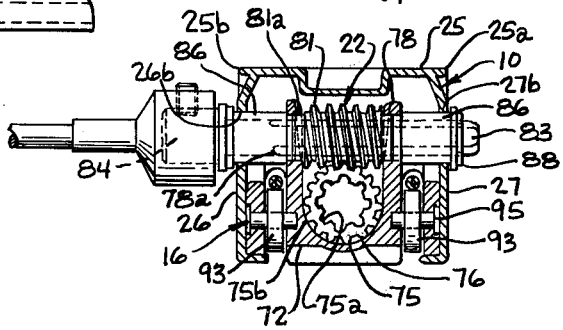
FIG. 8 is a fragmentary vertical sectional view through the channel taken on the plane 8—8 of FIG. 7.

The end fitting 16 is also disposed substantially entirely in the other end of the channel and includes an end wall 71 adapted to engage and overlie the end of the channel and a body portion 72 that extends into the channel adjacent the open side of the latter. The body portion 72 has axially aligned bearings 73 and 74 (FIG. 7) formed integrally therewith and dimensioned to rotatably receive and support an end of the spline shaft 19. A worm wheel 75 (FIG. 8) is disposed between the bearings 73 and 74 and has an internally splined opening 75*a* non-rotatably keyed to the shaft 19 and external gear teeth 75*b*. In order to facilitate assembly of the parts, the body portion 72 is formed with an upwardly opening semi-cylindrical recess 76 intermediate the bearings 73 and 74 and shaped to engage the outer periphery of the gear wheel 75 to support the same, at least until the gear 75 is assembled on the spline shaft. The body has upwardly extending flanges 78 extending along opposite sides the cavity 76 for the worm wheel in a direction generally lengthwise of the housing. A worm gear 81 meshes with the worm wheel and is supported for rotation about an axis crosswise of the housing. As shown in FIG. 8, the worm gear 81 has reduced diameter annular ends 81*a* that are rotatably supported in openings 78*a* in the flanges 78. The worm gear 81 has an internally splined opening that slidably and non-rotatably receives an externally splined cross shaft 83. The cross shaft has a drive head 84 at one end adapted to be connected to a shaft rotating mechanism. The cross shaft 83 extends through flanged bushings 86 positioned in openings 26*b*, 27*b* in the side walls 26 and 27 of the housing, and the flanged bushings are preferably provided with reduced diameter inner ends adapted to be received in the openings 78*a* in the flanges 78. Cross shaft 83 is removably secured in position by a split ring 88 that fits into a groove in the cross shaft at the end remote from the drive head 84. With this construction, the end fittings 15 can be inserted into the end of the housing and the bushings 86 then inserted through the lateral openings 26*b* and 27*b* in the side walls of the housing, and the cross shaft thereafter inserted through the bushings and worm gear, from either side of the housing. Thus, the cross shaft secures the end fitting 16 in the housing and, moreover, can be inserted from either side of the housing for left or right hand draw. In addition, the cross shaft 83 is arranged so that it can be operated from either side of the housing at a location where it does not interfere with movement of the blind slats between their open and closed positions. Thus, the blind slats can be arranged to extend to the end of the housing to avoid any significant light passage at the end of the blind assembly. In the embodiment illustrated, the cross shaft is rotated by means of a wand 91 that is connected through a flexible connector 92 to the drive head 84 on the cross shaft 85, to rotate the cross shaft and hence the spline shaft 19 in response to turning of the wand 91.

Cord guide pulleys 93 are also mounted on the end fitting 16 and, as best shown in FIG. 8, the pulleys 93 are disposed in generally upright passages 94 located at each side of the spline shaft 19, and are supported for rotation by means of pins 95. The passages 94 preferably extend through the end wall 71 of the body to facilitate threading of the cords over the pulleys and, as shown in FIG. 7, the periphery of the pulley is spaced a distance only slightly greater than the thickness of a traverse cord from the end walls 71, so that the vertical runs 14*c* of the traverse cords (FIG 1) are located closely adjacent the plane of the end of the housing.

From the foregoing it is felt that the construction and operation of the vertical venetian blind apparatus will be readilly understood. The carriages are shaped and arranged so that the carriages with the integral spacer arms can be molded in one piece of a synthetic resin material using a four-section mold to thereby minimize the number of parts which must be made and assembled to form the carriage. Further, the carriage, slat carrier, and rack members are shaped and arranged so that the slat carrier and rack members can be inserted as a subassembly into the carriages to thereby simplify final assembly of the slat carriers and gearing into the carriages. In addition, the carriages have cord passages extending from the top and opening at the bottom of the carriage and cord locks at the bottom of the carriage to facilitate connecting the traverse cord runs to the master or lead carriage. The end fitting 15 is locked in the channel by clamp fitting 63 and fasteners 64 and the end fitting 16 is locked in the other end of the channel by the cross shaft 83.

The carriages function to support the spline shaft, when the carriages are spaced apart along the channel. However, when the carriages are moved together to open the blind, the shft can sag somewhat in long installations. In order to reduce sagging, an intermediate support can be formed from one of the carriages by omitting the slat carrier and gear and by cutting off or otherwise removing the spacer arm. Such an intermediate support is shown at 11*c* in FIG. 11 and the intermediate support is maintained in position by stop members 99 positioned on the shaft at opposite sides of the intermediate support 11*c*. The stop members 99 are conveniently in the form of resilient U-shaped members that can be laterally pressed onto the spline shaft 99 and which resiliently clamp the shaft to retain the same in position. Similar stop members 99*a* and 99*b* can be provided on the spline shaft at opposite sides of the outermost carriages, to maintain the same in proper spaced relation to the end of the track.

In one-way rod installations, it is not possible to use a stationary intermediate support for the spline shaft. However, a travelling support for the spline shaft can be provided using a carriage such as 11*c*, modified to admit the spacer arm, slat support and gearing. The support carriage 11*c* is disposed between the master carriage 11*b* and the end fitting 15 on the trackway. The cord openings in the side walls of the carriages are dimensioned to loosely receive the runs of the traverse cord. However, the intermediate support 11*c* is provided with one reducing bushing 111 that extends into one pair of aligned cord passages 31*b*, 32*b*, and the traverse cord 14 is provided with an abutment 112 which is sufficiently small to pass through the cord openings in the carriages, but which will engage the reducer bushing 111 in the carriage 11*c* to move the carriage. The abutment 112 is provided on the run 14*c* of the traverse cord and is spaced from the lead carriage a distance approximating onehalf the distance between the lead carriage and the end of the track, when the carriages are retracted as shown in FIG. 12. With this arrangement, the carriage 11*c* will be moved to a position approximately mid-way between the lead carriage 11*c* and the end of the rod, when the blind is opened. As previously discussed, stops such as 99*a* and 99*b* can be provided on the spline shaft at opposite sides of the end carriage to normally maintain the same in a preselected position spaced about one-half the width of a slat from the end of the rod.

The embodiments of the invention in which an exclusive property or privilege is claimed are defined as follows:

1. In a vertical venetian blind closure of the type including a horizontal carriage guide channel having an opening along one side, a plurality of carriages mounted on the guide channel for movement therealong, a slat carrier mounted on each of said carriages for rotation relative thereto about an upright carrier axis, a splined shaft extending lengthwise of said channel, and gear means on each of said carriages engaging said splined shaft for turning the slat carriers about their upright axes in response to turning of the splined shaft, the improvement comprising: said carriages each having spaced side walls extending transverse to the channel and a bottom wall extending between the side walls adjacent the open side of the channel, the bottom wall having a carrier opening to allow the slat carrier to extend therethrough and said side walls having aligned shaft openings for the passage of said splined shaft therethrough, said gear means including a carrier pinion on each slat carrier coaxial with its upright axis and a rack member having a first rack adapted to mesh with the splined shaft and a second rack in a plane transverse to the first rack and adapted to mesh with the carrier pinion, said carriages having passage means between the side walls extending from the bottom wall and opening at the top of the carriage, said passage means being shaped to allow insertion of the slat carrier and rack member as a subassembly into the carriage from the top thereof and to laterally retain the rack member with the second rack in meshing engagement with the carrier pinion during and after insertion of the subassembly into the carrier, said carrier opening being non-circular and said slat carrier having a non-circular end portion adapted to be slidably and non-rotatably received in said carrier opening in a preselected angular position and an intermediate portion between the end portion and the carrier pinion dimensioned to allow rotation of the slat carrier after it is inserted in the carriage, said passage means having upright wall portions intermediate said side walls and engageable with the ends of the rack member to longitudinally position the rack member during insertion into the carriage, and said upright wall portions having their lower ends spaced above said bottom wall to allow lengthwise reciprocation of the rack member after it is inserted in the carriage, and each slat carrier and rack members having interengaging means for inhibiting relative movement of the rack member and slat carrier in a direction paralleling the slat carrier axis during and after insertion of the subassembly into carrier.

2. A vertical venetian blind closure according to claim 1 wherein said interengaging means includes a peripheral recess in each slat carrier adjacent the carrier pinion and a flange on the rack member adjacent the second rack extending into peripheral recess in the slat carrier.

3. A vertical venetian blind closure according to claim 2 wherein each rack member has a second flange paralleling the first mentioned flange and adapted to overlie the carrier pinion.

4. A vertical venetian blind closure according to claim 1 wherein said interengaging means includes first and second flanges on the rack member along opposite sides of the second rack and engageable with the carrier pinion on the slat carrier.

5. A vertical venetian blind closure according to claim 1 wherein said bottom wall has a circular depression around said carrier opening at the upper face of said bottom wall, said slat carrier having a circular shank portion above the non-circular end portion and an annular flange above the shank portion adapted to be rotatably received in said depression around said carrier opening when the slat carrier is inserted in the carriage.

6. A vertical venetian blind closure according to claim 5 wherein said interengaging means includes a peripheral recess in each slat carrier above its flange and below its carrier pinion and a flange on the rack member extending into the peripheral recess in the slat carrier.

7. A vertical venetian blind closure according to claim 6 wherein each rack member has a second flange paralleling the first mentioned flange thereon and adapted to overlie the carrier pinion.

8. A vertical venetian blind closure according to claim 1 wherein at least one of said carriages has first and second cord passages intermediate said side walls at relatively opposite sides of said passage means and each opening at the bottom and top ends of the carriage, said one carriage having a first pair of aligned cord openings in said side walls communicating with said first cord passage and a second pair of aligned cord openings in said side walls communicating with said second cord passage, traverse cord means having first and second relatively parallel runs respectively extending through said first and second pairs of cord openings in said one carriage, said cord passages in said one carriage being dimensioned to allow portions of a traverse cord to be drawn from the cord openings and downwardly between the side walls to the bottom of said one carriage.

9. A vertical venetian blind closure according to claim 8 including cord lock means at the bottom of said one carriage for engaging a portion of the traverse cord.

10. A vertical venetian blind closure according to claim 8 wherein said side walls have first and second pairs of downwardly opening notches at the bottom thereof respectively adjacent said first and second cord passages.

11. In a vertical venetian blind closure of the type including a horizontal carriage guide channel having an opening along one side, a plurality of carriages mounted in the guide channel for movement therealong traverse cord means having relatively parallel runs in the channel and connected to at least one of said carriages for moving the same along the channel, a slat carrier mounted on each of the carriages for rotation relative thereto about an upright carrier axis, a splined shaft extending lengthwise of said channel, and gear means on each of said carriages engaging said splined shaft for turning the slat carriers about their upright axes, the improvement wherein said carriages each have a generally rectangular body of synthetic resin material having spaced side walls and end walls and a bottom wall, the side walls having aligned shaft openings to allow passage of said shaft therethrough and said bottom wall having a carrier opening to allow the slat carrier to extend downwardly therethrough, said carriages each having upright intermediate walls extending between the side walls and spaced from each other and from the end walls to provide a central slat carrier passage and first and second cord passages at opposite sides of the central slat carrier passage, said side walls having first and second pairs of cord openings therethrough respectively communicating with the first and second cord passages, and said bottom wall having first and second cord openings respectively communicating with the first and second cord passages to allow portions of a traverse cord to pass through one of said pair of cord openings in the side walls and downwardly through a respective one of the cord passages and through a respective one of the cord openings in the bottom wall to the underside of the carriage.

12. A vertical venetian blind closure according to claim 11 wherein each carriage has a spacer link of said synthetic resin material integrally connected to one side wall by a thin flexible connecting portion to allow flexing of the link relative to the carriage, the other side wall of said carriages having an opening for slidably receiving the spacer link on an adjacent carriage, and stop means on the free end of the spacer link for limiting separating movement of adjacent carriages.

13. In a vertical venetian blind closure of the type including a horizontal carriage guide channel having an opening along one side, a shaft extending lengthwise of the guide channel, a plurality of carriages mounted in the guide channel for movement therealong and having spaced side walls extending traverse to the channel, said carriage having shaft openings in the spaced side walls for the passage of said shaft therethrough and two cord openings in opposed side walls, a slat carrier mounted on each of said carriages for rotation about a vertical axis, gear means in each of said carriages engageable with said shaft and with the respective slat carrier for rotating the latter in response to rotation of the shaft, traverse cord means having relatively parallel runs extending through said two cord guide openings, means connecting one run of said traverse cord means to one of said carriages for moving the same along the guide channel, said carriage spacer means for controlling the separating movement of said carriages, the improvement wherein at least said one carriage has passages intermediate said side walls extending from the two cord openings and opening between said side walls at the bottom face of said carriages adjacent said open side of the channel to allow portions of a traverse cord to be drawn from the cord openings and between the side walls to the bottom face of the carriage, and cord lock means at said bottom face of said one carriage for engaging portions of a traverse cord.

14. A vertical venetian blind closure according to claim 13 wherein said cord lock means comprises notches in said side walls at said outer face of said one carriage.

15. A vertical venetian blind according to claim 13 wherein said cord lock means comprises two notches formed in each of said side walls at said outer face of said one carriage.

16. In a vertical venetian blind closure of the type including a horizontal carriage guide channel having a top wall and spaced side walls and an opening along its lower side, a plurality of carriages mounted in the guide channel for movement therealong, traverse cord means having relatively parallel runs in the channel and connected to at least one of said carriages for moving the same along the channel, a slat carrier mounted on each carriage for rotation about an upright axis, a splined shaft extending lengthwise of the channel, gear means on each of said carriages engaging said splined shaft for turning the slat carriers in response to turning of the splined shaft, and shaft turning mechanism at one end of the shaft for turning the same, the improvement comprising, said shaft turning mechanism including a body disposed substantially entirely in said channel at one end thereof, a worm wheel having an internally splined bore non-rotatably received on one end of said splined shaft, means on said body engaging said worm wheel and supporting the same for axial rotation, a worm gear meshing with said worm wheel and mounted on said body for rotation about a horizontal axis perpendicular to said side walls of the channel, said worm gear having an internally splined opening, said side walls of said channel having openings aligned with said internally splined bore in the worm wheel, a bushing extending through each of said openings in the side walls of the channel and engaging the body internally of the channel, a cross shaft extending through said bushings in said side walls of the channel and through said internally splined opening in the worm gear and non-rotatably keyed thereto, and means engageable with one end of said cross shaft externally of the channel for turning the latter.

17. A vertical venetian blind according to claim 16 wherein said cross shaft has a drive head at one end for attachment to a drive member and means at its other end for releasably locking the cross shaft against axial withdrawal, whereby the cross shaft can be inserted into the worm gear from either side of the channel.

* * * * *

UNITED STATES PATENT AND TRADEMARK OFFICE

CERTIFICATE OF CORRECTION

PATENT NO. : 4,122,884

DATED : October 31, 1978

INVENTOR(S) : Ferdinand F. Salzmann

It is certified that error appears in the above-identified patent and that said Letters Patent are hereby corrected as shown below:

In Column 11, Claim 13, line 18, "said" should be -- and --.

Signed and Sealed this

*Sixth* Day of *March 1979*

[SEAL]

*Attest:*

RUTH C. MASON
*Attesting Officer*

DONALD W. BANNER
*Commissioner of Patents and Trademarks*